US009517907B2

(12) United States Patent
Nishikawa et al.

(10) Patent No.: US 9,517,907 B2
(45) Date of Patent: Dec. 13, 2016

(54) SHEET CONVEYING APPARATUS AND IMAGE FORMING APPARATUS

(71) Applicant: CANON KABUSHIKI KAISHA, Tokyo (JP)

(72) Inventors: Taku Nishikawa, Yokohama (JP); Miho Kaiga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/677,016

(22) Filed: Apr. 2, 2015

(65) Prior Publication Data

US 2015/0284201 A1 Oct. 8, 2015

(30) Foreign Application Priority Data

Apr. 3, 2014 (JP) ..... 2014-076751

(51) Int. Cl.
*B65H 9/04* (2006.01)
*B65H 9/00* (2006.01)
(Continued)

(52) U.S. Cl.
CPC ..... *B65H 9/004* (2013.01); *B65H 5/062* (2013.01); *B65H 5/068* (2013.01); *B65H 5/36* (2013.01);
(Continued)

(58) Field of Classification Search
CPC ..... B65H 5/06; B65H 5/062; B65H 5/068; B65H 9/004; B65H 9/006; B65H 2301/331; B65H 2404/1114; B65H 2404/1413; B65H 2601/272; B65H 2511/242; B65H 2404/50; B65H 2404/60; B65H 2404/63; B65H 2404/633; B65H 2404/65; B65H 2404/70; B65H 2404/722; B65H 2404/74; B65H 2404/741; B65H 2404/7414; B65H 2404/64
See application file for complete search history.

(56) References Cited

U.S. PATENT DOCUMENTS 5,543,909 A * 8/1996 Quesnel ..... B65H 9/006 271/228
6,564,966 B2 5/2003 Kaiga et al.
(Continued)

FOREIGN PATENT DOCUMENTS

CN 102574649 A 7/2012
EP 2492226 A1 8/2012
(Continued)

OTHER PUBLICATIONS

Miho Kaiga, U.S. Appl. No. 14/676,003, filed Apr. 1, 2015.
(Continued)

*Primary Examiner* — Prasad Gokhale
(74) *Attorney, Agent, or Firm* — Fitzpatrick, Cello, Harper & Scinto

(57) ABSTRACT

A sheet conveying apparatus includes first and second rotator pairs, a moving member including an abutment portion against which a front end of the sheet conveyed by the first rotator pair abuts and a guide member provided at upstream, in the sheet conveying direction, of a nip portion of a second rotator pair. The guide member configured to be movable to a first position where the guide member guides the sheet toward the moving member in a projection state and to a second position away from the moving member more than the first position and turns to the second position during when the sheet is conveyed by the second rotator pair.

17 Claims, 11 Drawing Sheets

(51) Int. Cl.
*B65H 5/06* (2006.01)
*B65H 5/36* (2006.01)

(52) U.S. Cl.
CPC ..... *B65H 9/006* (2013.01); *B65H 2301/331* (2013.01); *B65H 2404/1114* (2013.01); *B65H 2404/1413* (2013.01); *B65H 2404/50* (2013.01); *B65H 2404/60* (2013.01); *B65H 2404/633* (2013.01); *B65H 2404/64* (2013.01); *B65H 2404/65* (2013.01); *B65H 2404/70* (2013.01); *B65H 2404/722* (2013.01); *B65H 2404/74* (2013.01); *B65H 2404/741* (2013.01); *B65H 2404/7414* (2013.01); *B65H 2511/242* (2013.01); *B65H 2601/272* (2013.01)

(56) References Cited

U.S. PATENT DOCUMENTS

| | | | | |
|---|---|---|---|---|
| 8,430,392 | B2 | 4/2013 | Nada et al. | |
| 8,540,239 | B2 | 9/2013 | Kaiga et al. | |
| 2009/0184461 | A1* | 7/2009 | Ishikawa | B65H 5/062 271/254 |
| 2010/0237554 | A1* | 9/2010 | Okumura | B65H 9/006 271/109 |
| 2011/0089628 | A1* | 4/2011 | Watanabe | B65H 9/004 271/110 |
| 2012/0080838 | A1* | 4/2012 | Osada | B65H 5/062 271/228 |
| 2012/0153566 | A1* | 6/2012 | Ito | B65H 3/5261 271/265.01 |
| 2013/0087968 | A1 | 4/2013 | Watanabe et al. | |
| 2014/0077441 | A1 | 3/2014 | Watanabe et al. | |
| 2015/0028532 | A1* | 1/2015 | Takahashi | B65H 7/00 271/3.15 |
| 2015/0035227 | A1* | 2/2015 | Nakamura | B65H 5/062 271/246 |
| 2015/0191324 | A1* | 7/2015 | Fumoto | B65H 9/002 271/3.2 |

FOREIGN PATENT DOCUMENTS

| | | | |
|---|---|---|---|
| JP | 5318221 | B2 | 10/2013 |
| KR | 20120062937 | A | 6/2012 |
| WO | 2011048668 | A1 | 4/2011 |

OTHER PUBLICATIONS

Miho Kaiga, U.S. Appl. No. 14/677,001, filed Apr. 2, 2015.
Unpublished copending U.S. Appl. No. 14/676,003, to Miho Kaiga, filed Apr. 1, 2015.
Unpublished copending U.S. Appl. No. 14/677,001, to Miho Kaiga, filed Apr. 2, 2015.

* cited by examiner

SHEET CONVEYING APPARATUS AND IMAGE FORMING APPARATUS

BACKGROUND OF THE INVENTION

Field of the Invention

This disclosure relates to a sheet conveying apparatus conveying a sheet and an image forming apparatus.

Description of the Related Art

In the related art, an image forming apparatus such as a copier, a printer, or a facsimile includes an image forming portion, and a sheet conveying apparatus which conveys sheets to the image forming portion by using conveyance rollers. In the image forming apparatus of the related art, there are cases where a sheet is skewed when the sheet is conveyed due to a conveyance roller being deformed, alignment of the conveyance roller being deviated, or the like. Here, in the image forming apparatus, accuracy of an image forming position considerably depends on a position of a sheet relative to the image forming portion, and thus a major image quality factor is to match a position of the sheet with the image forming portion with high accuracy.

Therefore, in the image forming apparatus of the related art, a skew correction portion is provided in the sheet conveying apparatus, and accuracy of an image forming position is improved by correcting a sheet skew with the skew correction portion. As such a skew correction portion, there is a skew correction portion including a shutter member which is biased by a biasing portion such as a spring in a reverse direction to a direction of sheet conveyance and in which a sheet front end comes into abutment with the shutter member.

As disclosed in Japanese Patent No. 5318221, such a shutter type skew correction portion has been proposed which includes a conveyance roller, a conveyance driven roller, and a plurality of shutter members. The conveyance driven roller is in contact with the conveyance roller. The plurality of shutter members is provided rotatably coaxially with a shaft of the conveyance driven roller and each of the shutter members has a plurality of sheet abutment portions on a peripheral surface thereof. In the skew correction portion with this configuration, if a forefront portion of the front end of a skewed sheet comes into abutment with the sheet abutment portion of one of the plurality of shutter members, the sheet is stopped in a state in which the sheet front end is in contact with the sheet abutment portion by receiving a reaction force from the sheet abutment portion. Then, if the sheet is further conveyed, the sheet is deflected. If the sheet is deflected in this way, the sheet front end comes into abutment with the sheet abutment portions of the plurality of shutter members. Consequently, the sheet skew is corrected, and then the sheet of which the skew has been corrected enters a nip between the conveyance roller and the conveyance driven roller and is conveyed to a downstream side.

Meanwhile, in recent years, there has been a demand for improvement in the productivity, that is, improvement in the number of sheets on which images are formed per unit time in the image forming apparatus. For this reason, a sheet conveyance speed has been increased, or an interval (hereinafter, referred to as an inter-sheet distance) between a rear end of a sheet and a front end of the following sheet, the sheets being continuously conveyed, has been reduced. Due to the increase in a sheet conveyance speed or the reduction in the inter-sheet distance, the shutter member is required to return to a skew correction position within a short inter-sheet distance after a preceding sheet passes.

For example, if a skew of a preceding sheet is corrected, the shutter member of the related art is pushed and rotated by the sheet. When the shutter member is rotated by a predetermined distance, the shutter member is moved by a cam portion to a position where a skew of a sheet which is conveyed next is corrected by the following sheet abutment portion. Even if the shutter member is moved as mentioned above, the following sheet abutment portion is in contact with an upper surface of the conveyed sheet until the rear end of the preceding sheet passes through the sheet abutment portion.

Therefore, the movement of the following sheet abutment portion to the position for correcting a sheet skew is performed after the rear end of the preceding sheet passes the shutter member. Thus, the inter-sheet distance between the preceding and succeeding sheets is required to be set such that the front end of the succeeding sheet does not reach the shutter member during a period from when the rear end of the preceding sheet passes through the shutter member until when the following abutment surface moves to the position for correcting the skew of the sheet.

SUMMARY OF THE INVENTION

According to an aspect of this disclosure, there is provided a sheet conveying apparatus including a first rotator pair conveying a sheet, a second rotator pair provided at downstream, in a sheet conveying direction, of the first rotator pair, a moving member including an abutment portion against which a front end of the sheet conveyed by the first rotator pair abuts, and being movable from a projection state in which the abutment portion projects into a sheet conveying path at upstream, in the sheet conveying direction, of a nip portion of the second rotator pair to a passage state in which the sheet is permitted to pass through the moving member as the abutment portion is pressed by the sheet conveyed by the first rotator pair, and a guide member provided at upstream in the sheet conveying direction of the nip portion of the second rotator pair and movable to a first position where the guide member guides the sheet toward the moving member in the projection state and to a second position away from the moving member more than the first position, the guide member taking the second position during when the sheet is conveyed by the second rotator pair.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
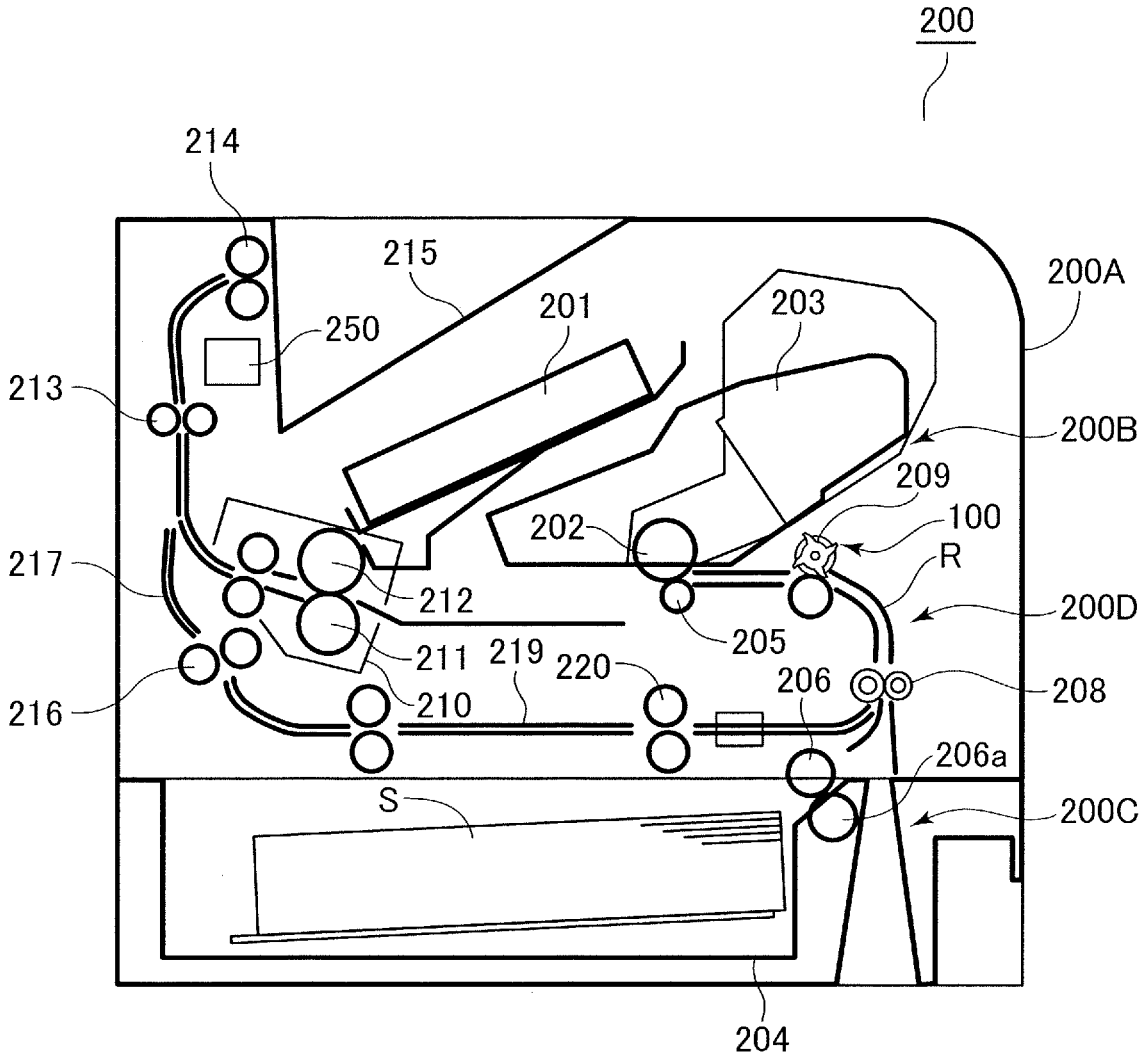
FIG. 1 is a diagram illustrating a schematic configuration of a laser printer as an example of an image forming apparatus including a sheet conveying apparatus according to a first embodiment of this disclosure.

Hereinafter, embodiments of this disclosure will be described in detail with reference to the drawings. FIG. 1 is a diagram illustrating a schematic configuration of a laser printer as an example of an image forming apparatus including a sheet conveying apparatus according to a first embodiment of this disclosure. In FIG. 1, the reference numeral 200 indicates a laser printer, and the reference numeral 200A indicates a laser printer main body (hereinafter, referred to as an apparatus main body). The reference numeral 200B indicates an image forming portion provided in the apparatus main body 200A.

The reference numeral 200C indicates a sheet feeding apparatus provided on a lower part of the apparatus main body 200A. The reference numeral 200D indicates a sheet conveying apparatus which includes a skew correction portion 100, corrects a skew of a sheet which is fed by the sheet feeding apparatus 200C by using the skew correction portion 100, and conveys the sheet to the image forming portion 200B. The reference numeral 250 indicates a control portion which is provided at a predetermined position of the apparatus main body 200A, and controls an image forming operation in the image forming portion 200B, a sheet conveying operation in the sheet conveying apparatus 200D, and the like.

The image forming portion 200B includes a cartridge unit 203 provided with a photoconductive drum 202 as an image carrier, and a laser scanner 201 which exposes the photoconductive drum 202 to light. When an image is formed, the photoconductive drum 202 is exposed to light by the laser scanner 201 such that a latent image is formed on a photoconductive drum surface, and then the latent image is developed, thereby allowing a toner image to be formed on the photoconductive drum surface.

The sheet feeding apparatus 200C includes a sheet feeding cassette 204 as a sheet stacking portion which is attachably and detachably provided in the apparatus main body 200A, and a sheet feeding roller 206 which is provided above the sheet feeding cassette 204 and feeds a sheet S stored in the sheet feeding cassette 204. In addition, the sheet feeding apparatus 200C includes a separating roller 206*a* constituting a separating unit which is in pressure contact with the sheet feeding roller 206 and separates sheets S fed by the sheet feeding roller 206 from each other.

The sheet feeding apparatus 200C configured as mentioned above feeds the sheets S stored in the sheet feeding cassette 204 by using the sheet feeding roller 206 in parallel to a toner image forming operation in the above-described image forming portion 200B. The sheets are separated one by one by the separating roller 206*a*. The separated sheet S is conveyed to the skew correction portion 100 by a first conveyance roller pair 208 of the sheet conveying apparatus 200D, provided on a sheet conveyance path R. The sheet S of which a skew has been corrected by the skew correction portion 100 is conveyed to a transfer portion constituted by the photoconductive drum 202 and a transfer roller 205.

The transfer portion transfers the toner image formed on the photoconductive drum surface onto the sheet S which has been conveyed to the transfer portion, and then the sheet is conveyed to a fixing portion 210. The fixing portion 210 includes a drive roller 211 and a fixing roller 212 which has a heater built thereinto. The sheet S is heated and pressed while passing through the drive roller 211 and the fixing roller 212, and thus the toner image is fixed onto the sheet S. The sheet S having undergone the fixing process is discharged onto a discharge tray 215 outside the apparatus by an internal-discharging roller pair 213 and an external-discharging roller pair 214.

On the other hand, in a case where an image is also formed on the other surface, the sheet of which an image is formed on one surface passes through the fixing portion 210, and is then conveyed in a switched-back manner due to reversion of the internal-discharging roller pair 213 and the external-discharging roller pair 214. The sheet is conveyed to the transfer portion by conveyance rollers 216 and 220 provided in a reverse conveying path 219 in a state in which a skew of the sheet has been corrected by the skew correction portion 100 again. An image is formed on the other surface in the transfer portion, and then the sheet is discharged onto the discharge tray 215.

Figure 2:
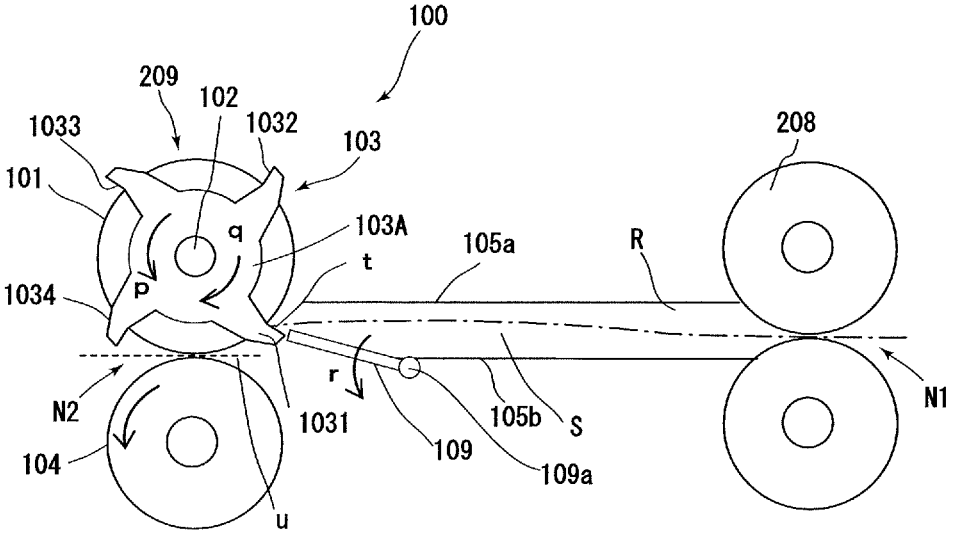
FIG. 2 is a diagram illustrating a configuration of a skew correction portion provided in the sheet conveying apparatus.

Here, as illustrated in FIG. 2, the skew correction portion 100 includes a second conveyance roller pair 209 and a shutter member 103. The second conveyance roller pair 209 is constituted by a drive roller 104 and a driven roller 101 which comes into pressure contact with the drive roller 104 and performs driven rotation according to rotation of the drive roller 104. The driven roller 101 is a first rotator provided on a same side with the shutter member 103 with respect to a nip portion N2 of the second conveyance roller pair 209 and the drive roller 104 is a second rotator disposed opposite to the first rotator in the present embodiment. The drive roller 104 receives a drive force from a drive portion (not illustrated) so as to be rotated in a counterclockwise direction. As illustrated in FIGS. 3A to 3C and FIG. 4, a plurality of the driven rolling members 101 are provided in an axial direction, and are rotatably supported at a conveyance frame 20. The driven rolling members 101 do not contact with a shutter shaft 102 as a result of inner diameter portions thereof having gaps with respect to the shutter shaft 102 substantially located on the same axis.

More specifically, in this embodiment, the skew correction portion 100 includes four shutter members 103 (103A to 103D). Each of the shutter members 103 is fixed onto the shutter shaft 102 in the same phase, and is rotatably supported at a conveyance frame 20. Here, the shutter member 103 is provided with at least one, four in the present embodiment, protruding portions 1031 to 1034 for temporarily stopping a front end of the sheet S in a contact manner along its circumferential surface in order to correct a skew of the front end of the sheet S as illustrated in FIG. 2 described above.

That is, each of shutter members 103 is a rotator including first through fourth protruding portions 1031 to 1034 each of which protrudes from the outer periphery and these protruding portions 1031 to 1034 configure an abutment portion against which a front end of the sheet conveyed by the first conveyance roller pair 208 abuts in this embodiment. In addition, as illustrated in FIG. 2, a phase position where one of the protruding portions 1031 to 1034 comes into abutment with a front end of the conveyed sheet S is hereinafter referred to as a skew correction standby position of the shutter member 103.

Also, the phase positions of the shutter member 103 where the first through forth protruding portions 1031 through 1034 protrude into the sheet conveying path R at upstream, in the sheet conveying direction, of the nip portion N2 of the second conveying roller pair 209 are refereed to first through fourth abutment positions respectively.

Figure 4:
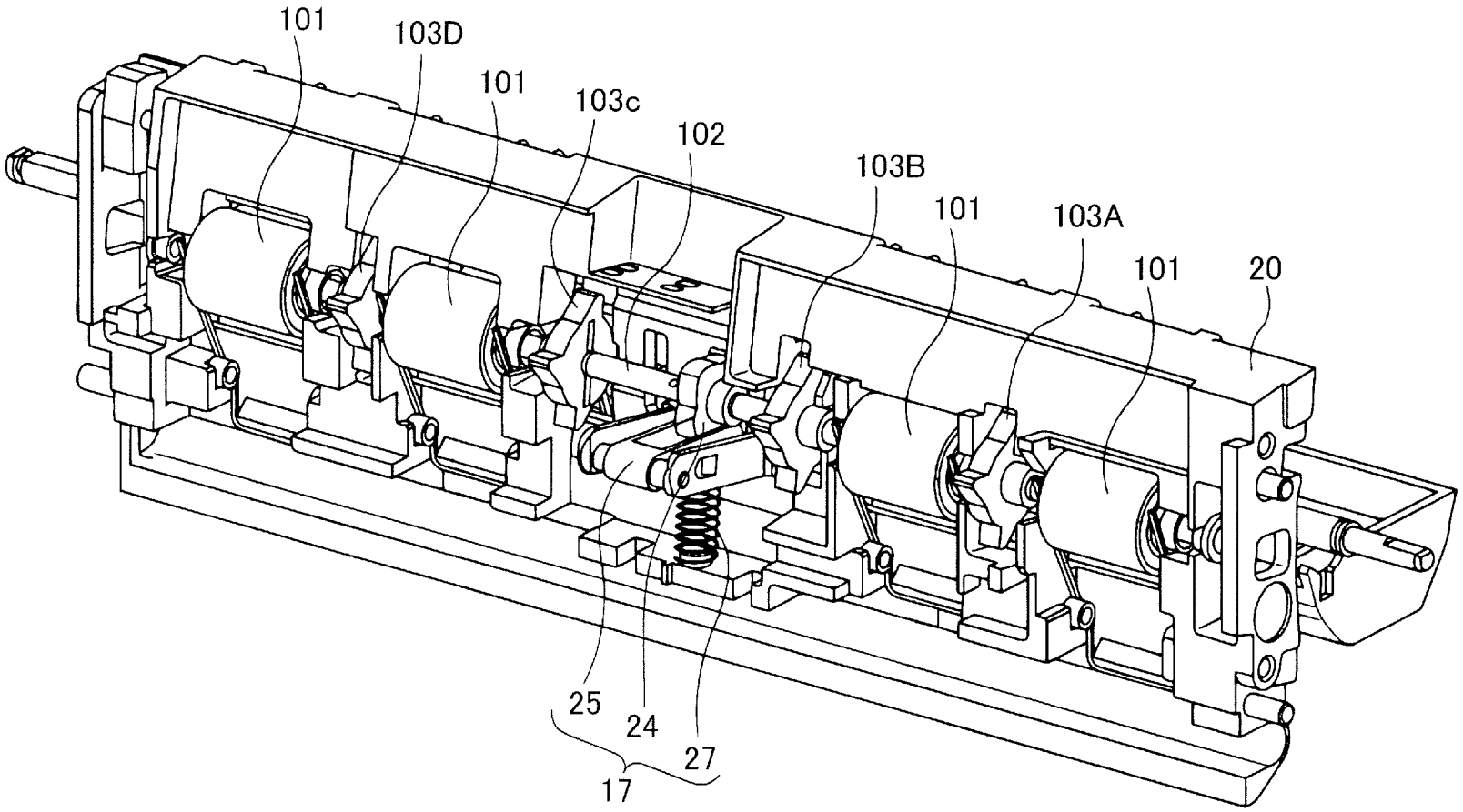
FIG. 4 is a perspective view illustrating the configuration of the skew correcting portion.

Furthermore, as described in FIG. 4, the skew correcting portion 100 includes a positioning mechanism 17 positioning the plurality of shutter members 103 at predetermined rotational positions. The positioning mechanism 17 includes a cam member 24 fixed onto the shutter shaft 102, a bias arm 25 biasing the cam member 24, and a bias spring 27 biasing the bias arm 25. The cam member 24 has the same number of cams (four in the present embodiment) with the protruding portions 1031 through 1034. The cams are formed such that the protruding portions 1031 through 1034 are positioned at the standby position. That is, the cam member 24 is formed of four sets of a resistance side cam surface and a driving side cam surface formed with a top dead point between them by its outer circumferential surface and has four bottom dead points corresponding to the first through fourth abutment positions (between the driving side cam surface and the adjacent resistance side cam surface). The bias arm 25 includes a cam follower in contact with the cam (the set of the resistance side and driving side cam surfaces) of the cam member 24 and oscillates in a state biased by the bias spring 27 to position the cam member 24 to a predetermined position (bottom dead point) such that the protruding portions 1031 through 1034 are positioned at the standby position.

That is, cam member 24 the shutter member 103 is stopped at the skew correction standby positions by a holding force of the cam member 24 member 24. When a sheet is conveyed, if one of the protruding portions 1031 to 1034 is pressed from the sheet S by the holding force or more of the cam member 24, the shutter member 103 is rotated in an arrow q direction with respect to the shutter shaft 102.

When the rotation progresses by a predetermined angle or more, the shutter member 103 is located at the skew correction standby position where the following protruding portion 1032 comes into abutment with a sheet, by the holding force of the cam member 24. As described above, the shutter member 103 turn to an projection state in which one of the abutment portion (protruding portion) protrudes into the sheet conveying path R at upstream, in the sheet conveying direction, of the nip portion N2 of the second conveying roller pair 209 by being positioned one of the first through forth positions. And the shutter member 103 is the rotator being movable from the projection state to a passage state in which the sheet is allowed to pass through the abutment portion as the abutment portion is pressed by the sheet conveyed by the first conveying roller pair 208. For instance, the shutter member 103 turns to the projection state when the first protruding portion 1031 protrudes into the sheet conveying path R at upstream, in the sheet conveying direction, of the nip portion N2 of the second rotator pair 209, and rotates until when the shutter member 103 turns again to the projection state, through the passage state on a halfway, by the second protruding portion 1032 protruding into the sheet conveyance path R at upstream in the sheet conveying direction of the nip portion N2 of the second rotator pair 209 as the first protruding portion 1031 being pressed by the sheet.

In FIG. 2, the reference numerals 105*a* and 105*b* respectively indicate upper and lower conveyance guides which are provided between the first conveyance roller pair 208 and the second conveyance roller pair 209 and constitute the sheet conveyance path R. The upper conveyance guide 105*a* is a first conveyance guide provided on a side of the driven roller 101 and the lower guide 10*b* is a second conveyance guide provided on a side of the driving roller 104 in this embodiment. The first conveyance roller pair 208 constitutes a first rotator pair and the second conveyance roller pair 209 constitutes a second rotator pair. As illustrated in FIG. 2, a movable guide 109 is provided at a downstream end of the lower conveyance guide 105*b* in the sheet conveyance direction. The movable guide 109 can be swung (can be moved) in the vertical direction with a shaft 109*a* as a supporting point. The movable guide 109 is typically held at a position where the sheet S conveyed by the first conveyance roller pair 208 is directed toward the protruding portions 1031 to 1034.

In other words, the movable guide 109 is a guide member provided at upstream, in the sheet conveying direction, of the nip portion N2 of the second conveyance roller pair 209 and movable to a first position where the guide member 109 guides the sheet toward the shutter member (moving member) 103 in the projection state and to a second position away from the shutter member 103 more than the first position.

Also, the movable guide 109 is provided on a side closer to the second conveyance roller pair 209 than a middle point of the sheet conveying path R between the first and second conveyance roller pair 208 and 209 in the sheet conveying direction. More specifically, the movable guide 109 is disposed on a side of the driving roller (second rotator) 104 across the nip portion N2 of the second conveyance roller pair 209 and is disposed between an end in the sheet conveying direction of the conveyance guide (second conveyance guide) 105*b* and the second conveyance roller pair 209.

Furthermore, the movable guide 109 is inclined in a direction approaching from a side of the driving roller (second rotator) 104 to a side of the driven roller (first rotator) 101 toward the shutter member 103 when the movable guide 109 is located at the first position. More specifically, the movable guide 109 intersects with a nip line, which is a tangential line at the nip portion, of the nip portion N2 of the second conveyance roller pair 209 when the movable guide 109 is located at the first position and does not intersect with the nip line when the movable guide 109 is located at the second position. It is noted that the nip line refers to a straight line orthogonal to a straight line connecting centers of rotation of the first and second rollers of the rotator pair and is a tangential line of the roller at the nip portion.

Figure 5A:
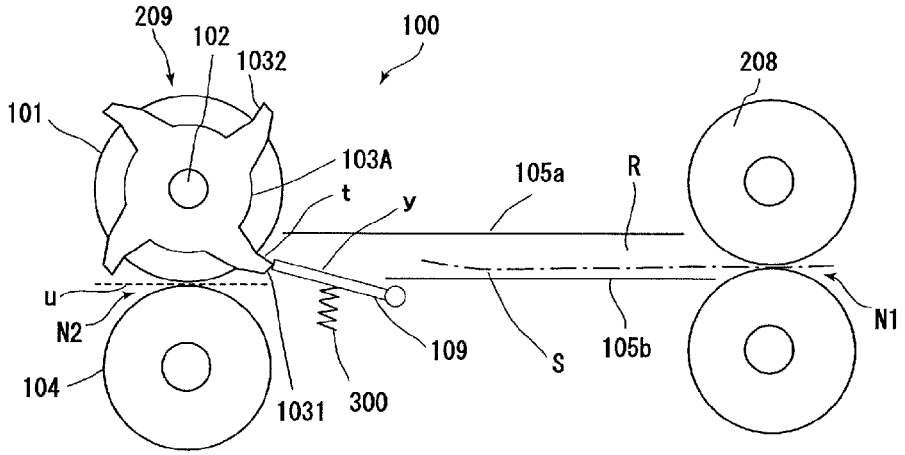
FIG. 5A is a side view illustrating a state in which the sheet is conveyed toward the shutter member.
Figure 5B:
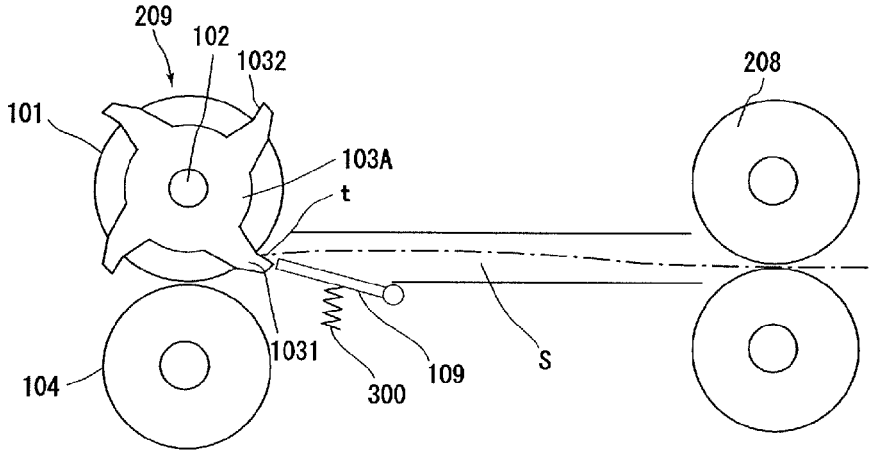
FIG. 5B is a side view illustrating a state in which the sheet abuts against the shutter member.

Hereinafter, a position where the front end of the conveyed sheet S is brought into abutment with one of the protruding portions 1031 to 1034 by the movable guide 109 is referred to as a front end passing position t. As illustrated in FIG. 5A to be described later, a position where a conveyed sheet is guided toward one of the protruding portions 1031 to 1034 (front end passing position t) by the movable guide 109 is referred to as a guide position y. In addition, as illustrated in FIG. 6A to be described later, a position where a conveyed sheet is directed toward a nip portion N2 of the second conveyance roller pair 209 by the movable guide 109 is referred to as a retracting position z. The movable guide 109 is moved between the guide position y which is the first position and the retracting position z which is the second position. The retracting position z is substantially parallel to an imaginary straight line which connects a nip portion N1 of the first conveyance roller pair 208 to the nip portion N2 of the second conveyance roller pair 209. The movable guide 109 is held at the guide position y by a bias member 300 and a rotation stopper (not illustrated). The movable guide 109 is biased by the bias member 300 so as to be held at the guide position illustrated in FIGS. 5A to 5C.

Here, as illustrated in FIG. 2, the shutter member 103 is disposed such that the protruding portions 1031 to 1034 come into abutment with a sheet which is conveyed along the conveyance guides 105 (105*a* and 105*b*) and are located above the nip line of the second conveyance roller pair 209. It is noted that the nip line is an imaginary line orthogonal to a straight line connecting between rotation centers of the first and second rollers of the roller pair. In a case where the protruding portions 1031 to 1034 are disposed at this position, the sheet S which is guided along the conveyance guides 105 and is conveyed comes into abutment with the protruding portions 1031 to 1034 at the front end passing position t which is located above the nip line of the second conveyance roller pair 209.

As will be described later, if the sheet S conveyed by the first conveyance roller pair 208 is sent to the second conveyance roller pair 209, the sheet S passes along a conveyance passing route u which is the nip line of the second conveyance roller pair 209. In other words, after the sheet S is conveyed and reaches the front end passing position t while being guided by the movable guide 109, the sheet S passes through the second conveyance roller pair 209 via the conveyance passing route u which is a path different from the previous path. Here, in the present embodiment, a conveyance direction when a sheet passes along the conveyance passing route u is set to form an obtuse angle with respect to the guide direction caused by the movable guide 109 going in a positive direction, i.e., counterclockwise direction, when viewed from a direction of a rotation axis of the second conveying roller pair 209. The imaginary straight line which connects the nip portion N1 of the first conveyance roller pair 208 to the nip portion N2 of the second conveyance roller pair 209 is disposed so as not to intersect the protruding portions 1031 to 1034 of the shutter member 103 located at the abutment position.

6. The sheet conveying apparatus according to claim 3, wherein the guide member intersects with a nip line that is a tangential line of the nip portion of the second rotator pair when the guide member is located at the first position and does not intersect with the nip line when the guide member is located at the second position.

Next, a description will be made of a skew correction operation in the skew correction portion 100 with this configuration. FIG. 5A illustrates a state in which the front end of the sheet S has not yet reached the skew correction portion 100, that is, a state in which the sheet S has not come into abutment with the protruding portion 1031 of the shutter member 103A. Although not illustrated, the other shutter members 103B to 103D perform the same operation.

In this case, the shutter member 103A is located at the skew correction standby position which is a abutment position of coming into abutment with the sheet on a sheet conveyance direction upstream side of the nip portion N2 of the second conveyance roller pair 209.

Figure 3A:
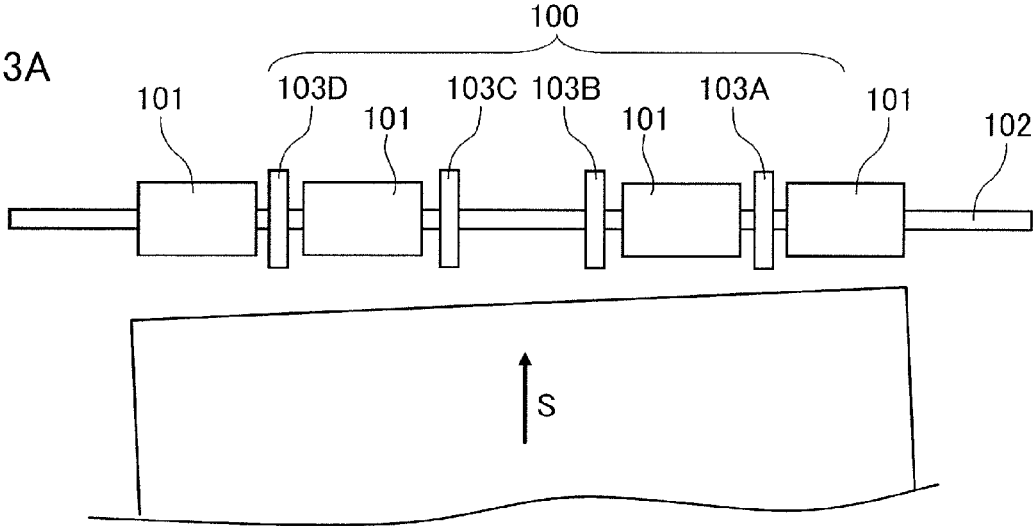
FIG. 3A is a plane view illustrating a skew correcting operation in the skew correcting portion.
Figure 3B:
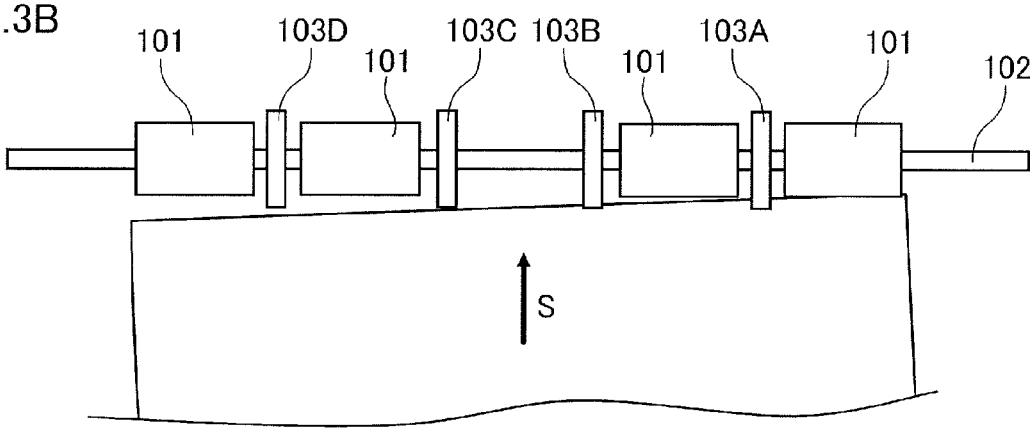
FIG. 3B is a plane view illustrating a state in which a forefront portion of a front end of a sheet abuts with a shutter member.

The sheet S is conveyed to the first conveyance roller pair 208 by the sheet feeding roller 206 and is then conveyed along the conveyance guides 105 by the first conveyance roller pair 208. Thus, the sheet S reaches the front end passing position t as illustrated in FIG. 5B. At this time, the movable guide 109 lies at the guide position y, and the sheet S reaches the front end passing position t while being guided by the movable guide 109. Here, for example, in a case where the sheet S is skewed in a state in which the right part of the sheet S precedes as illustrated in FIG. 3A, the sheet S comes into abutment with the protruding portion 1031 of the shutter member 103A located at one end side in the width direction among the shutter members 103A to 103D as illustrated in FIG. 3B. In this case, the protruding portion 1031 is a first protruding portion.

Figure 3C:
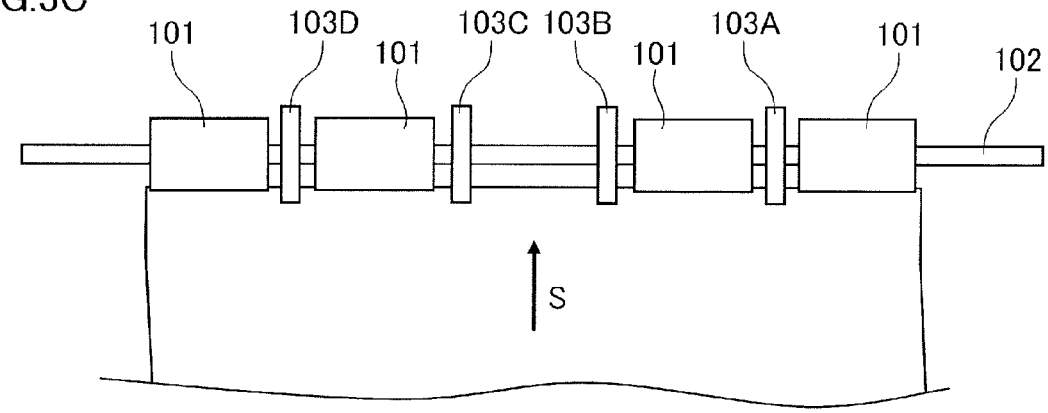
FIG. 3C is a plane view illustrating a state in which the front end of a sheet abuts with the shutter members and the skew of the sheet is corrected.

At this time, the shutter member 103 receives a biasing force from a biasing portion (not illustrated) in an arrow p direction illustrated in FIG. 2. For this reason, the front end of the sheet S comes into abutment with the protruding portion 1031 and is stopped to form a loop, and sequentially comes into abutment with the protruding portions 1031 of the other shutter members 103B to 103D as illustrated in FIG. 3C. Since the front end of the sheet S comes into abutment with the protruding portions 1031 of all the shutter members 103A to 103D, the front end of the sheet S is aligned in a straight line parallel to the shutter shaft 102, and thus the skew is corrected.

If the loop further grows, stiffness increases in the sheet S, and thus the shutter member 103 is pushed by the sheet S. If the shutter member 103 is pressed by the sheet S at a predetermined pressure or higher, the shutter member 103A is rotated about the shutter shaft 102 and is moved to a passing position where the sheet enters the nip portion N2 of the second conveyance roller pair 209.

Figure 5C:
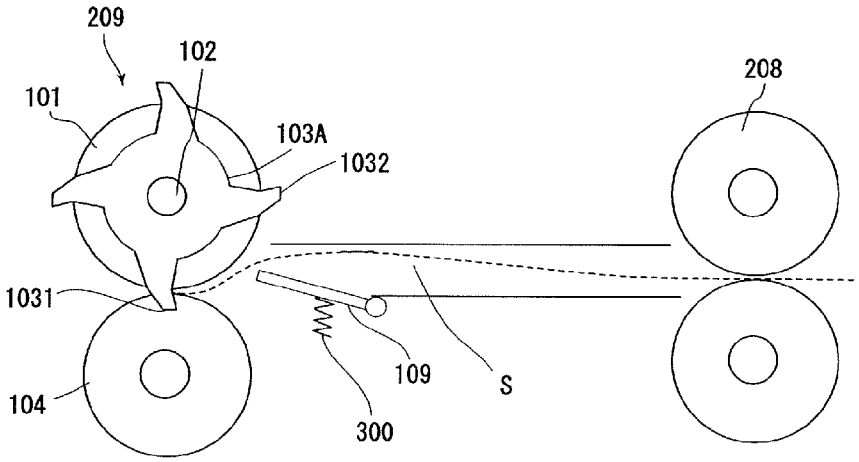
FIG. 5C is a side view illustrating a state in which the shutter member rotates by being pressed by the sheet.
Figure 6A:
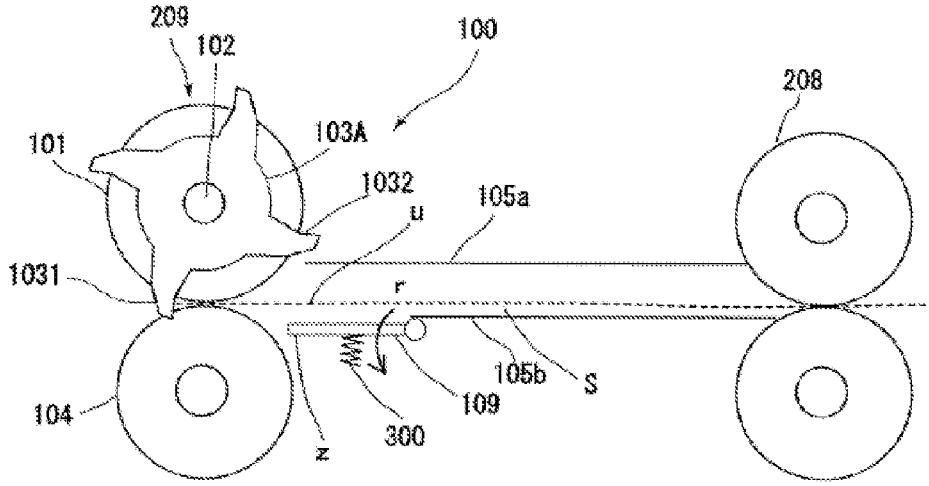
FIG. 6A is a side view illustrating a state in which the sheet conveyed by first and second conveyance roller pairs.
Figure 6B:
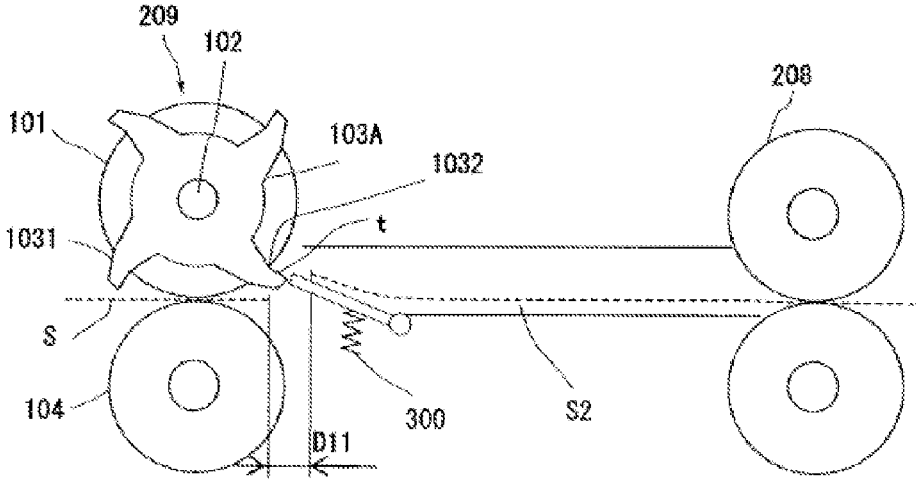
FIG. 6B is a side view illustrating a state in which the sheet is guided by a movable guide returned to a first position from a second position.

Consequently, the front end of the sheet S enters the nip portion N2 of the second conveyance roller pair 209 in a state in which the skew correction is maintained, as illustrated in FIG. 5C. At this time, the shutter member 103A is pressed by the front end of the sheet S and is thus continuously rotated. Then, the sheet S is conveyed by the second conveyance roller pair 209 in a state in which the skew has been corrected, and passes along the conveyance passing route u which is on the nip line of the second conveyance roller pair 209 as illustrated in FIG. 6A. It is noted that the nip line refers to a straight line orthogonal to a straight line connecting centers of rotation of the first and second rollers of the rotator pair and is a tangential line of the roller at the nip portion. Since FIGS. 6A to 6B illustrate a central portion of the sheet S in the width direction, the sheet S is not in abutment with the movable guide 109, but the movable guide 109 is moved as a result of coming into abutment with other portions (not illustrated) of the sheet S.

Here, as described above, since the sheet conveyance direction of the sheet passing along the conveyance passing route u is set to form an obtuse angle with respect to the guide direction caused by the movable guide 109 going in the positive direction, the sheet S enters the nip portion N2 of the second conveyance roller pair 209 while changing its conveyance direction. If the sheet S has entered the nip portion N2 of the second conveyance roller pair 209, the loop is removed. Due to the removal of the loop, the movable guide 109 receives a biasing force by the stiffness of the sheet S in a direction becoming distant from the shutter member 103A so as to be pivoted in an arrow r direction and to be moved to the retracting position z. Consequently, the sheet S is separated from the shutter member 103 and is conveyed along the movable guide 109 which has been moved to the retracting position z.

when the conveyance of the sheet S further progresses, and the shutter member 103A is rotated by a predetermined angle or more, the shutter member 103A is rotated by the cam member 24. At this time, since the sheet S is being separated from the shutter member 103, the shutter member 103A is rotated until the protruding portion 1032 which is a second protruding portion is located at the skew correction standby position, and is then stopped. Consequently, the shutter member 103A is ready to correct a skew of the following sheet S2. As mentioned above, if the front end of the sheet S is conveyed to the nip portion N2 of the second conveyance roller pair 209, the movable guide 109 is moved to the retracting position z, and the shutter member 103 is also moved to the skew correction standby position by the cam member 24. Since the shutter member 103 is provided such that a rear end of the sheet does not pass on a moving trajectory of the abutment portion (protruding portion) in moving from the passage state to the projection state, the shutter member 103 turns from the passage state to the projection state before the rear end of the sheet passes through the shutter member 103 after turning to the passage state by being pressed by the front end of the sheet. That is, the shutter member 103 moves from the passage state to the projection state before the rear end of the sheet passes through the shutter member 103 by the movable guide 109 moving in the direction away from the shutter member 103.

The following sheet S2 starts to be conveyed during the conveyance of the sheet S, and the following sheet S2 is conveyed along the conveyance guides 105 (105*a* and 105*b*). If the rear end of the sheet S comes out of the first conveyance roller pair 208, the biasing force caused by the stiffness of the sheet S becomes smaller than a biasing force of the bias member 300 in a reverse r direction, and thus the movable guide 109 is moved to the guide position y by the biasing force of the bias member 300.

Next, if the following sheet S2 reaches the movable guide 109 which has been moved to the guide position y, the sheet S2 is guided by the movable guide 109 and comes into abutment with the protruding portion 1032 of the shutter member 103A at the front end passing position t as illustrated in FIG. 6B. If the conveyance further progresses, skew correction for the following sheet S2 is started in the same manner as in the sheet S. At this time, the shutter member 103A is located at the skew correction standby position where the protruding portion 1032 comes into abutment with the following sheet before the front end of the sheet S2 reaches the protruding portion 1032, and vibration or the like is also settled. Therefore, skew correction of the following sheet S2 can be started. Consequently, a preparation of the shutter members 103A to 103D for correcting the skew of the following sheet S2 can be finished regardless of a position of the rear end of the preceding sheet S. As a result, a distance D11 between the rear end of the preceding sheet S and the front end of the following sheet S2 can be made about 0.

As described above, in the present embodiment, the movable guide 109 is pivoted and thus a sheet is separated from the shutter member 103 after a sheet front end passes through the front end passing position until a sheet rear end comes out of the shutter member 103. Consequently, the shutter member 103 is moved to the skew correction standby position. The movable guide 109 returns to the guide position y right after the sheet rear end passes through the movable guide 109. Consequently, skew correction of the following sheet can be started before the rear end of the sheet completely comes out of the shutter member 103, and thus it is possible to perform skew correction at a shorter inter-sheet distance than in the related art.

As mentioned above, since the shutter member 103 is moved to the skew correction standby position before a rear end of a sheet passes through the shutter member 103, a skew of the sheet can be corrected at a short inter-sheet distance even in a case where a sheet conveyance speed is high. Since a sheet skew can be corrected even at a short inter-sheet distance, it is possible to increase the number of sheets on which an image is formed. Since a sheet is separated from the shutter member 103 before a rear end of the sheet passes therethrough, it is possible to prevent a scratch, folding, or the like of the sheet S caused by the shutter member 103. When a user pulls out the sheet S during a jamming process, it is possible to prevent the sheet S from being scratched as a result of being caught in the shutter member 103.

Figure 7:
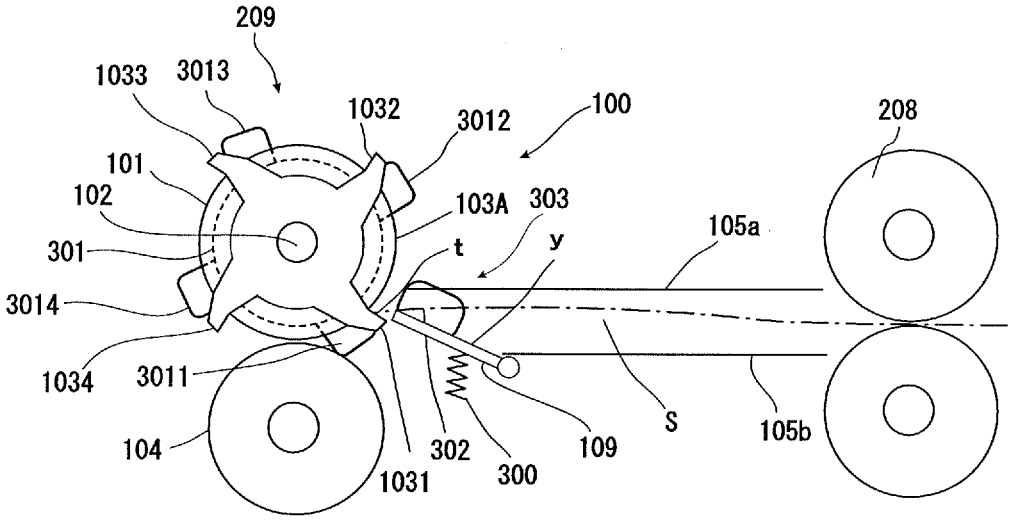
FIG. 7 is a diagram illustrating a configuration of a sheet conveying apparatus according to a second embodiment of this disclosure.

Next, a second embodiment of this disclosure will be described. FIG. 7 is a diagram illustrating a configuration of a sheet conveying apparatus according to the present embodiment. In FIG. 7, the same reference numerals indicate similar or corresponding portions in FIG. 2 described above. In FIG. 7, the reference numeral 301 indicates a cam fixed to the shutter shaft 102 of the shutter members 103 (103A to 103D) on the same axis and outside a sheet passing region. The cam 301 is integrally formed with the shutter members 103. The reference numeral 302 indicates a projecting portion which is a cam follower provided on the movable guide 109. In the present embodiment, a shifting portion 303 which moves the movable guide 109 to a guide position and a standby position is constituted by the cam 301 and the projecting portion 302.

The cam 301 includes a plurality of, in the present embodiment, four pushing portions 3011 to 3014 which push the projecting portion 302 of the movable guide 109 from an upper side. The four pushing portions 3011 to 3014 have the same phases as those of the four protruding portions 1031 to 1034 of the shutter member 103. The cam 301 is installed at the shutter shaft 102 so that the four pushing portions 3011 to 3014 have the same positional relationship with the four protruding portions 1031 to 1034 of the shutter member 103. That is, cam 301 is a cam member rotating together with the shutter member 103 and including a protrusion, i.e., pushing portion, abutting against the movable guide 109 and moving the movable guide 109 from the first position to the second position.

The cam 301 comes into pressure contact with the projecting portion 302 until the shutter member 103 is rotated to the skew correction standby position, but is disposed to be separated from the projecting portion 302 when the shutter member 103 is located at the skew correction position. Consequently, the cam 301 is separated from the projecting portion 302 when the shutter member 103 is located at the skew correction position. The cam 301 comes into pressure contact with the projecting portion 302 so as to move the movable guide 109 from the guide position to the standby position in a predetermined period of time until the shutter member 103 is rotated and is located at the next skew correction position.

It is noted that while the present embodiment is explained by exemplifying the skew correcting portion 100 includes the four second conveyance roller pairs 209 and the four shutter members 103, a number of the second conveyance roller pairs 209 and the shutter members are not limited to four. Also, while the present embodiment is explained by exemplifying the shutter member 103 includes the four protruding portions 1031 to 1034, a number of the protruding portions is not limited to four.

Next, a description will be made of a skew correction operation in the skew correction portion 100 with this configuration. FIG. 7 illustrates a state in which the front end of the sheet S has not yet reached the skew correction portion 100, that is, a state in which the sheet S has not come into abutment with the protruding portion 1031 of the shutter member 103A. Although not illustrated, the other shutter members 103B to 103D perform the same operation. At this time, the shutter member 103A is located at the skew correction standby position. The movable guide 109 is located at the guide position y.

Figure 8A:
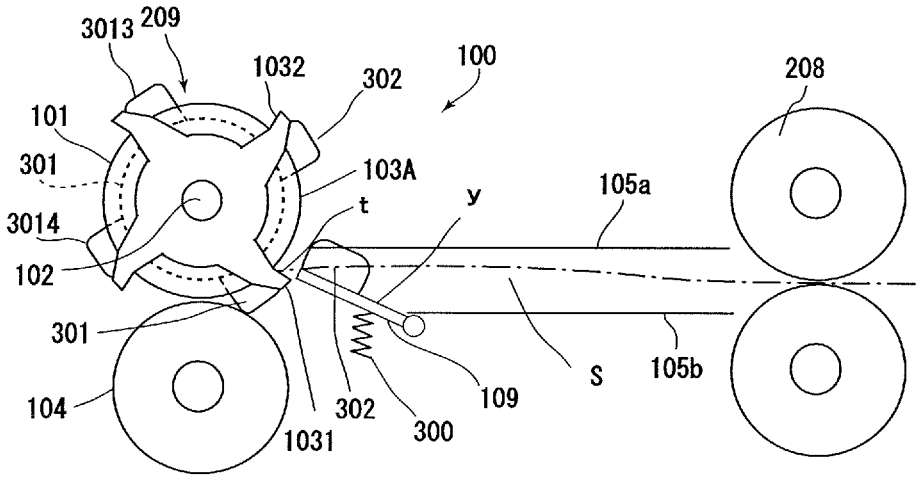
FIG. 8A is a diagram illustrating a state in which the sheet is guided toward the shutter member by the movable guide in the first position.
Figure 8B:
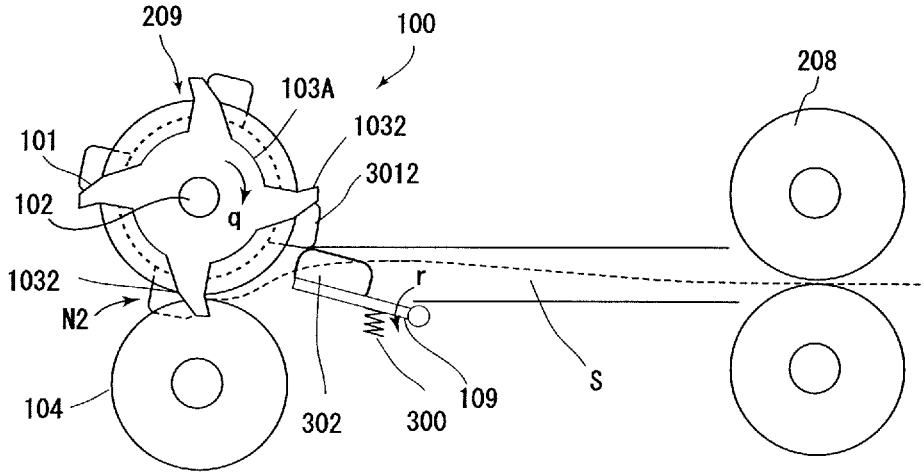
FIG. 8B is a side view illustrating a state in which a pushing portion of a cam abuts against the movable guide.

The sheet S is conveyed to the first conveyance roller pair 208 by the sheet feeding roller 206 and is then conveyed along the conveyance guides 105 by the first conveyance roller pair 208. Thus, the sheet S is guided by the movable guide 109 and reaches the front end passing position t as illustrated in FIG. 8A. At this time, in a case where the sheet S is skewed, the skew is corrected in the same manner as in the above-described first embodiment. Then, the sheet S of which the skew has been corrected rotates the shutter member 103A about the shutter shaft 102 and also enters the nip portion N2 of the second conveyance roller pair 209 as illustrated in FIG. 8B.

Figure 9A:
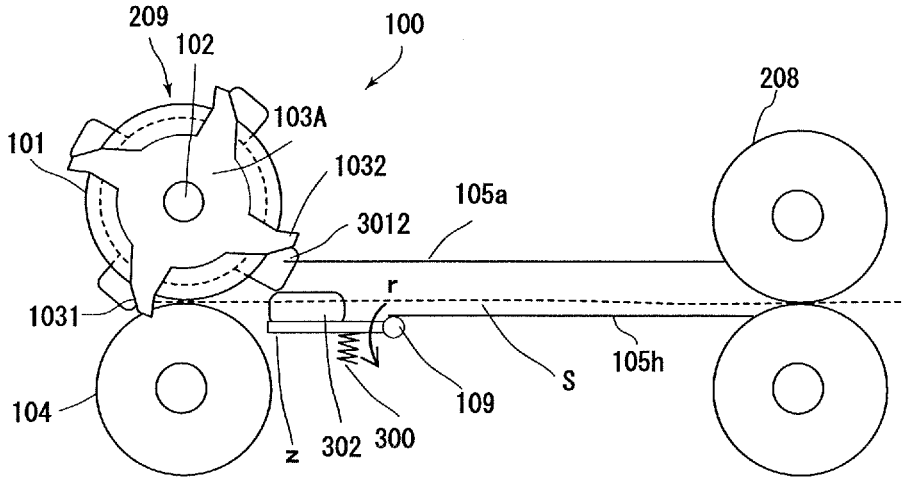
FIG. 9A is a side view illustrating a state in which the movable guide is pushed into the second position by the pushing portion.

Consequently, as illustrated in FIG. 9A, a conveyance path of the sheet S changes from the route along the conveyance guides 105 until the sheet S reaches the front end passing position t to the conveyance passing route u which is a nip line of the second conveyance roller pair 209. At this time, the shutter member 103A is pressed by the front end of the sheet S and is thus continuously rotated. Here, when the shutter member 103A is rotated, the cam 301 is rotated interlocked with the rotation of the shutter member 103A in an arrow q direction, and pushes the movable guide 109 via the projecting portion 302. Thus, the movable guide 109 is pivoted in an arrow r direction and is moved to the retracting position z. Consequently, the sheet S is conveyed along the movable guide 109 separated from the shutter member 103A and moved to the retracting position z.

If the conveyance of the sheet S further progresses, and the shutter member 103A is rotated by a predetermined angle or more, the shutter member 103A is rotated to and stopped at the skew correction standby position where the following protruding portion 1032 comes into abutment with a sheet, by the cam member 24. Consequently, the shutter member 103A is ready to correct a skew of the following sheet S2.

Figure 9B:
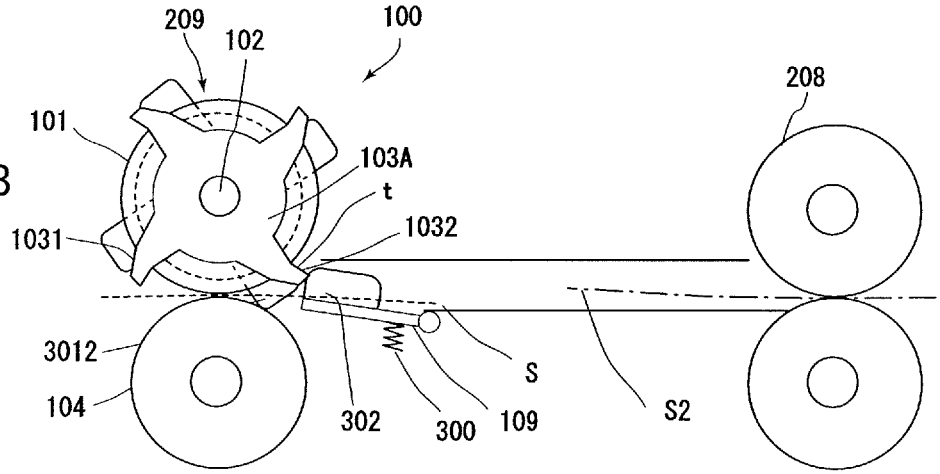
FIG. 9B is a side view illustrating a state in which the abutment of the pushing portion with the movable guide is released.

Here, if the shutter member 103A is rotated to the skew correction position where the following protruding portion 1032 comes into abutment with the sheet, the cam 301 integrally rotated with the shutter member 103A is rotated in a direction in which the pushing portion 3012 is separated from the projecting portion 302. Consequently, the movable guide 109 receives a biasing force from the bias member 300 and is thus moved to the standby position side. As illustrated in FIG. 9B, the following sheet S2 starts to be conveyed during the conveyance of the sheet S, and the following sheet S2 is conveyed along the conveyance guides 105 through the first conveyance roller pair 208.

The following sheet S2 is guided by the movable guide 109 which has been moved to the guide position illustrated in FIG. 8A described above, and comes into abutment with the protruding portion 1032 of the shutter member 103A which is located at the skew correction standby position, at the front end passing position t. Then, if the conveyance further progresses, skew correction for the following sheet S2 is started in the same manner as in the sheet S.

Here, the shutter member 103A is located at the skew correction standby position before the front end of the sheet S2 reaches the protruding portion 1032, and vibration or the like is also settled. Therefore, skew correction of the following sheet can be started. Consequently, a preparation of the shutter members 103A to 103D for correcting the skew of the following sheet S2 can be finished regardless of a position of the rear end of the preceding sheet S. As a result, a distance between the rear end of the preceding sheet S and the front end of the following sheet S2 can be made about 0.

As described above, in the present embodiment, the movable guide 109 is pivoted by the cam 301 after a sheet passes through the front end passing position until the sheet comes out of the shutter member 103. Therefore, the shutter member 103 is moved to the skew correction standby position. The movable guide 109 returns to the guide position y right after the sheet passes through the movable guide 109 so that the following sheet is guided to the shutter member 103 which has been moved to the skew correction standby position.

Consequently, skew correction of the following sheet can be started before the rear end of the sheet completely comes out of the shutter member 103, and thus it is possible to perform skew correction at a shorter inter-sheet distance than in the related art. A case has been described hitherto in which the movable guide 109 is moved by the cam 301, but this disclosure is not limited thereto, and the movable guide 109 may be moved by using a solenoid as a shifting portion.

Meanwhile, a case has been described hitherto in which the shutter member 103 includes a plurality of protruding portions, and is pivoted in one direction, but this disclosure is not limited thereto. A shutter member may be used which includes a single protruding portion and is reciprocally moved between the passing position and the skew correction standby position.

Figure 10:
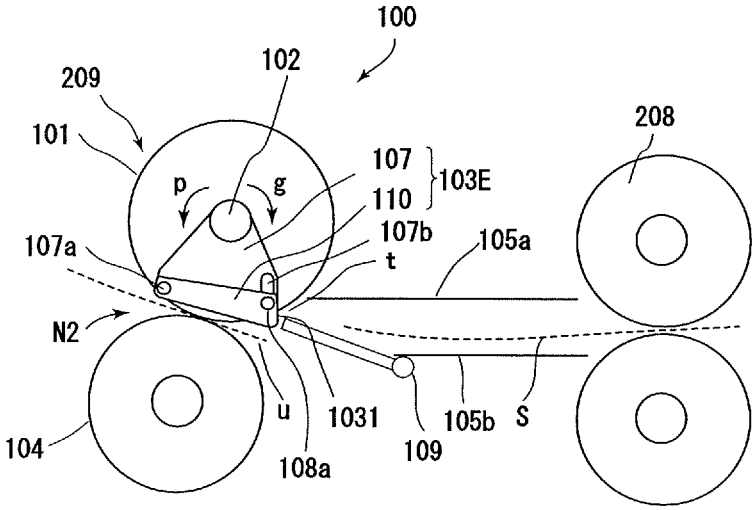
FIG. 10 is a diagram illustrating a configuration of a sheet conveying apparatus according to a third embodiment of this disclosure.

Next, a third embodiment of this disclosure using such a shutter member will be described. FIG. 10 is a diagram illustrating a configuration of a sheet conveying apparatus according to the present embodiment. In FIG. 10, the same reference numerals indicate similar or corresponding portions in FIG. 2 described above. In FIG. 10, the reference numeral 103E indicates a shutter member. A plurality of shutter members 103E are fixed to the shutter shaft 102 in the same phase, and are rotatably supported at a conveyance frame 24.

Each of the shutter members 103E includes a base member 107 and a pivot member 110. The base member 107 is pivoted about the shutter shaft 102 in directions indicated by arrows p and q. The pivot member 110 is pivoted about a shutter shaft 107*a* provided at the base member 107 in the vertical direction, and a pin 108*a* locked to a groove 107*b* is provided at a pivot end portion. The groove 107*b* is provided at the base member 107. A protruding portion 1031 for temporarily stopping a front end of the sheet S in a contact manner is provided at a distal end of the pivot member 110 in order to correct a skew of the front end of the sheet S. Here, in the present embodiment, the shutter member 103E is disposed such that the protruding portion 1031 comes into abutment with a sheet which is conveyed along the conveyance guides 105 (105*a* and 105*b*) and is located above a nip line of the second conveyance roller pair 209.

Figure 11A:
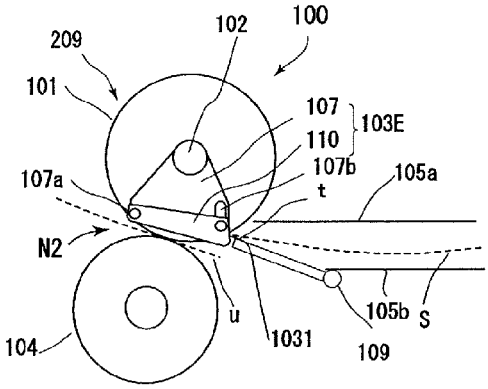
FIG. 11A is a side view illustrating a state in which the sheet is conveyed toward the shutter member.
Figure 11B:
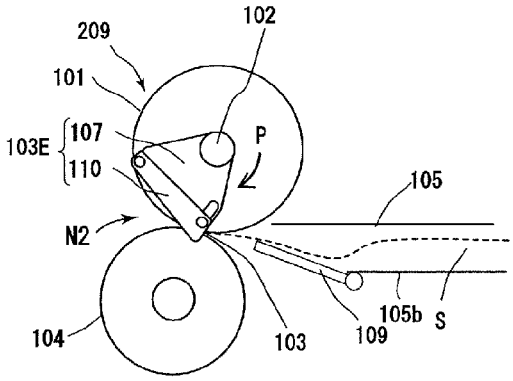
FIG. 11B is a side view illustrating a state in which the sheet abuts against the movable guide.
Figure 11C:
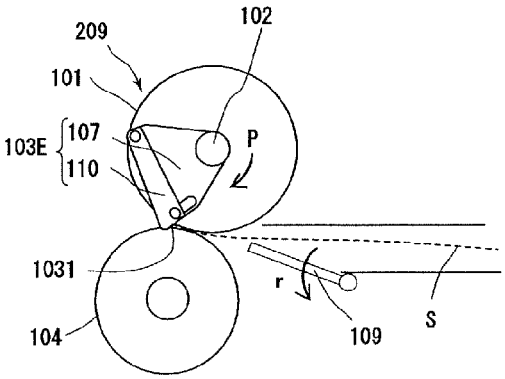
FIG. 11C is a side view illustrating a state in which the shutter member rotates by being pressed by the sheet.
Figure 11D:
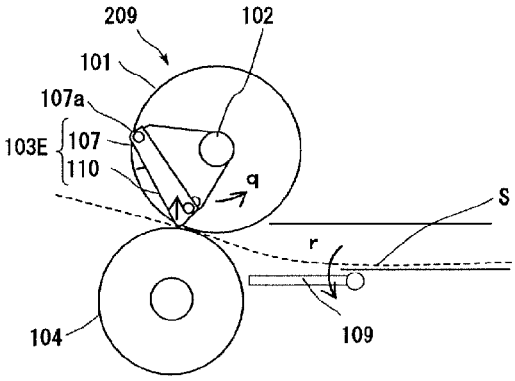
FIG. 11D is a side view illustrating a state in which the shutter member turns to the second position by the sheet conveyed by the second conveyance roller.
Figure 11E:
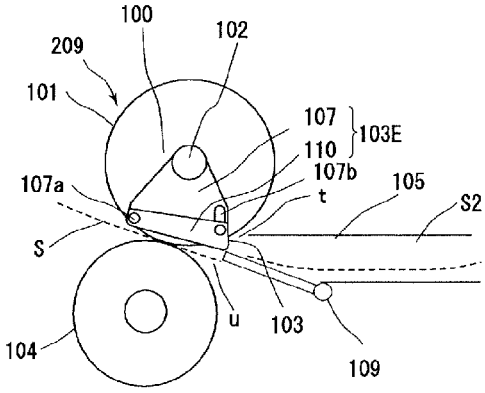
FIG. 11E is a side view illustrating a state in which the movable guide returned to the first position from the second position.

The shutter member 103E receives a biasing force from a torsion coil spring (not illustrated) in an arrow p direction, and is stopped by a stopper member (not illustrated) at the skew correction standby position where the protruding portion 1031 comes into abutment with a sheet. If the protruding portion 1031 comes into abutment with the sheet S, and the protruding portion 1031 is pushed by the contacting sheet S by a predetermined pressure or higher, the shutter member 103E is pivoted about the shutter shaft 102 in an arrow q direction. If the shutter member 103E is pivoted by a predetermined angle or more, as illustrated in FIG. 11D to be described later, the pivot member 110 is pushed up by the sheet S and is thus pivoted upwardly about the shutter shaft 107*a*. Accordingly, the base member 107 is pivoted in the arrow q direction and is thus moved to the skew correction position. That is, the shutter member 103E reciprocates an abutment position where the protruding portion (abutment portion) 1031 projects into the sheet conveying path at upstream, in the sheet conveying direction, of the nip portion N2 of the second conveyance roller pair 209 and a setback position where the abutment portion 1031 is set back from the sheet conveying path by being pressed by the sheet.

Next, a description will be made of a skew correction operation in the skew correction portion 100 with this configuration. FIG. 10 illustrates a state in which the front end of the sheet S has not yet reached the skew correction portion 100, that is, a state in which the sheet has not come into contact with the protruding portion 1031 of the shutter member 103E. At this time, the shutter member 103E is located at the skew correction standby position. Although not illustrated, other shutter members perform the same operation. The movable guide 109 is located at the guide position.

The sheet S is conveyed to the first conveyance roller pair 208 by the sheet feeding roller 206 and is then conveyed along the conveyance guides 105 by the first conveyance roller pair 208. Thus, the sheet S is guided by the movable guide 109 and reaches the front end passing position t as illustrated in FIG. 11A. At this time, in a case where the sheet S is skewed, a loop is formed and the skew is corrected in the same manner as in the above-described first embodiment. As illustrated in FIG. 11B, the sheet S of which the skew has been corrected then rotates the shutter member 103E by the stiffness of the sheet about the shutter shaft 102 in an arrow p direction, and enters the nip portion N2 of the second conveyance roller pair 209 in a state where the skew correction is maintained.

At this time, a conveyance path of the sheet S changes from the route along the conveyance guides 105 until the sheet S reaches the front end passing position t to the conveyance passing route u which is on the nip line of the second conveyance roller pair 209. At this time, the shutter member 103E is pressed by the front end of the sheet S and is thus continuously rotated. Here, if the conveyance path of the sheet S changes to the conveyance passing route u, the stiffness of the sheet S causes the movable guide 109 to be pivoted in an arrow r direction and to be moved to the retracting position as illustrated in FIG. 11C. Consequently, the sheet S is conveyed along the movable guide 109 separated from the shutter member 103E and moved to the retracting position z.

If the conveyance of the sheet S further progresses, and the shutter member 103E is rotated by a predetermined angle or more, the pivot member 110 is pushed up by the sheet S as illustrated in FIG. 11D. Consequently, the pivot member 110 moves the pin 108*a* upwardly along the groove 107*b*, and is pivoted about the shutter shaft 107*a* in an arrow q direction. Since the pivot member 110 is pivoted and a distal end portion thereof comes close to the shutter shaft 102 in the central direction, a pressure received from the sheet is reduced. Consequently, the base member 107 is pivoted about the shutter shaft 102 in the arrow q direction and is moved to the skew correction standby position. Thus, the shutter member 103E is ready to correct a skew of the following sheet S2.

The following sheet S2 has already started to be conveyed during the conveyance of the sheet S, and the following sheet S2 is conveyed along the conveyance guides 105 through the first conveyance roller pair 208. The following sheet S2 is brought into abutment with the pivot member 110 of the shutter member 103E which is located at the skew correction standby position, at the front end passing position t. Then, if the conveyance further progresses, skew correction for the following sheet S2 is started in the same manner as in the sheet S.

Here, the shutter member 103E is located at the skew correction standby position before the front end of the sheet S2 reaches the pivot member 110, and vibration or the like is also settled. Therefore, skew correction of the following sheet can be started. Consequently, a preparation of the shutter members 103A to 103D for correcting the skew of the following sheet S2 can be finished regardless of a position of the rear end of the preceding sheet S. As a result, a distance between the rear end of the preceding sheet S and the front end of the following sheet S2 can be made substantially 0.

As described above, in the present embodiment, a sheet is separated from the shutter member 103E, and the shutter member 103E is moved to the skew correction standby position before a rear end of the sheet passes through the shutter member 103E. Consequently, it is possible to correct a skew of the sheet at a short inter-sheet distance even in a case where a sheet conveyance speed is high. In other words, also in a case of using the shutter member 103E having a single protruding portion 1031, it is possible to achieve the same effect as in the above-described first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076751, filed Apr. 3, 2014, which is hereby incorporated by reference herein in its entirety.

What is claimed is:

1. A sheet conveying apparatus comprising:

a first rotator pair conveying a sheet;

a second rotator pair provided downstream, in a sheet conveying direction, of the first rotator pair;

a moving member including an abutment portion against which a front end of the sheet conveyed by the first rotator pair abuts, and being movable from a projection state in which the abutment portion projects into a sheet conveying path upstream, in the sheet conveying direction, of a nip portion of the second rotator pair to a passage state in which the sheet is permitted to pass through the moving member as the abutment portion is pressed by the sheet conveyed by the first rotator pair; and a guide member provided upstream in the sheet conveying direction of the nip portion of the second rotator pair and movable to a first position where the guide member awaits the sheet conveyed from the first rotator pair and guides the front end of the sheet toward the moving member in the projection state and to a second position away from the moving member more than the first position, the guide member configured to move from the first position to the second position by being pushed by the sheet which is nipped by the first and second rotator pairs, and to return from the second position to the first position after the sheet comes out of the first rotator pair and before the sheet comes out of the second rotator pair, wherein the moving member is a rotator configured to rotate in one direction by being pressed by the sheet.

2. The sheet conveying apparatus according to claim 1, wherein the guide member is provided on a side closer to the second rotator pair than a middle point of the sheet conveying path between the first and second rotator pairs in the sheet conveying direction.

3. The sheet conveying apparatus according to claim 2, wherein the second rotator pair includes a first rotator provided on a same side with the moving member with respect to a nip portion of the second rotator pair and a second rotator disposed opposite to the first rotator; and wherein the guide member is disposed on a side of the second rotator across the nip portion of the second rotator pair and is inclined in a direction approaching from a second rotator side to a first rotator side toward the moving member when the guide member is located at the first position.

4. The sheet conveying apparatus according to claim 3, further comprising a guide portion including a first conveyance guide provided on the first rotator side and a second conveyance guide provided on the second rotator side, and forming the sheet conveying path between the first and second rotator pairs, wherein the guide member is disposed between an end in the sheet conveying direction of the second conveyance guide and the second rotator pair.

5. The sheet conveying apparatus according to claim 3, wherein the guide member intersects with an imaginary straight line connecting the nip portions of the first and second rotator pairs in the first position and is located on the second rotator side of the imaginary straight line connecting the nip portions of the first and second rotator pairs in the second position.

6. The sheet conveying apparatus according to claim 1, further comprising a bias member biasing the guide member toward the first position, wherein the guide member takes the second position by being pressed by the sheet conveyed while being nipped by the nip portions of the first and second conveying rotator pairs.

7. The sheet conveying apparatus according to claim 6, wherein the guide member is configured such that the first protruding portion does not intersect with a nip line, which is a tangential line of the nip portion of the second rotator pair, in a state in which the first protruding portion projects into the sheet conveying path upstream in the sheet conveying direction of the nip portion of the second rotator pair, and the second protruding portion does not intersect with the nip line of the second rotator pair in a state in which the first protruding portion projects into the sheet conveying path upstream in the sheet conveying direction of the nip portion of the second rotator pair.

8. The sheet conveying apparatus according to claim 1, wherein the moving member is the rotator including at least first and second protruding portions, as the abutment portion, projecting from an outer periphery thereof, and rotates from the projection state in which the first protruding portion projects into the sheet conveying path upstream in the sheet conveying direction of the nip portion of the second rotator pair until when the moving member turns to the projection state again as the second protruding portion projects into the sheet conveying path upstream in the sheet conveying direction of the nip portion of the second rotator pair, through the passage state on a halfway, by the first protruding portion being pressed by the sheet.

9. The sheet conveying apparatus according to claim 8, wherein the moving member is the rotator including at least first and second protruding portions, as the abutment portion, projecting from an outer periphery thereof, and rotates from the projection state in which the first protruding portion projects into the sheet conveying path upstream in the sheet conveying direction of the nip portion of the second rotator pair until when the moving member turns to the projection state again as the second protruding portion projects into the sheet conveying path upstream in the sheet conveying direction of the nip portion of the second rotator pair, through the passage state on a halfway, by the first protruding portion being pressed by the sheet, and wherein the guide member is configured such that the first protruding portion does not intersect with a nip line, which is a tangential line of the nip portion of the second rotator pair, in a state in which the first protruding portion projects into the sheet conveying path upstream in the sheet conveying direction of the nip portion of the second rotator pair, and the second protruding portion does not intersect with the nip line of the second rotator pair in a state in which the first protruding portion projects into the sheet conveying path upstream in the sheet conveying direction of the nip portion of the second rotator pair.

10. The sheet conveying apparatus according to claim 1, further comprising a cam member rotating together with the moving member, the cam member including a protrusion abutting against the guide member and moving the guide member from the first position to the second position.

11. The sheet conveying apparatus according to claim 1, further comprising a solenoid moving the moving member from the first position to the second position.

12. The sheet conveying apparatus according to claim 1, wherein the moving member is provided such that a rear end of the sheet does not pass on a moving trajectory of the abutment portion in moving from the passage state to the projection state.

13. The sheet conveying apparatus according to claim 1, wherein the moving member turns from the passage state to the projection state before the rear end of the sheet passes through the moving member after turning to the passage state by being pressed by the front end of the sheet.

14. An image forming apparatus comprising:

an image forming portion; and the sheet conveying apparatus according to claim 1, configured to convey a sheet.

15. A sheet conveying apparatus comprising:

a first rotator pair conveying a sheet;

a second rotator pair provided downstream, in a sheet conveying direction, of the first rotator pair;

a moving member including an abutment portion against which a front end of the sheet conveyed by the first rotator pair abuts and being movable from a projection state in which the abutment portion projects into the sheet conveying path upstream, in the sheet conveying direction, of a nip portion of the second rotator pair to a passage state in which the sheet is permitted to pass through the moving member as the abutment portion is pressed by the sheet conveyed by the first rotator pair; and a guide member being movable from a first position, in which the guide member awaits the sheet conveyed from the first rotator pair and guides the front end of the sheet toward the moving member in the projection state, to a direction away from the moving member, the guide member configured to move from the first position to the direction away from the moving member if the sheet is nipped by the first and second rotator pairs and pushes the guide member, and to return to the first position after the sheet comes out of the first rotator pair and before the sheet comes out of the second rotator pair, wherein the moving member is a rotator configured to rotate in one direction by being pressed by the sheet.

16. The sheet conveying apparatus according to claim 15, wherein the moving member moves from the passage state to the projection state before the rear end of the sheet passes through the moving member by the guide member moving in the direction away from the moving member.

17. The sheet conveying apparatus according to claim 15, further comprising a bias member biasing the guide member toward the first position, wherein the guide member moves in the direction away from the moving member by resisting against a bias force of the bias member as the guide member is pressed by the sheet conveyed by the second rotator pair.

* * * * *